US008246391B1

(12) United States Patent
Qu et al.

(10) Patent No.: US 8,246,391 B1
(45) Date of Patent: Aug. 21, 2012

(54) CONNECTOR TERMINAL

(75) Inventors: Zhi-Cheng Qu, Guang-Dong (CN); Bing-Tao Yang, Guang-Dong (CN); Yin-Lung Wu, New Taipei (TW); Ming-Chiang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/091,118

(22) Filed: Apr. 20, 2011

(51) Int. Cl.
*H01R 13/40* (2006.01)

(52) U.S. Cl. ..... 439/733.1

(58) Field of Classification Search ..... 439/733.1, 439/680, 159, 188, 884, 746, 751, 559, 557, 439/862, 775
See application file for complete search history.

(56) References Cited

U.S. PATENT DOCUMENTS 6,354,891 B1 * 3/2002 Schnell et al. ..... 439/862
6,821,163 B2 * 11/2004 McHugh et al. ..... 439/733.1
6,896,532 B2 * 5/2005 Chang ..... 439/188
7,128,613 B1 * 10/2006 Lee et al. ..... 439/630
7,364,471 B2 * 4/2008 Takahashi et al. ..... 439/680
7,435,116 B2 * 10/2008 Wang ..... 439/188
7,510,443 B2 * 3/2009 Ma ..... 439/630
7,547,220 B1 * 6/2009 Wang et al. ..... 439/188
7,798,859 B1 * 9/2010 Yang ..... 439/630
7,803,011 B1 * 9/2010 Mai ..... 439/500
7,896,670 B1 * 3/2011 Gao et al. ..... 439/159
8,118,608 B2 * 2/2012 Wang et al. ..... 439/188

* cited by examiner

*Primary Examiner* — Alexander Gilman
(74) *Attorney, Agent, or Firm* — Cheng-Ju Chiang

(57) ABSTRACT

A connector terminal is assembled in an insulating housing defining a receiving cavity of which front and rear sides protrude face-to-face to form two blocking eaves. The connector terminal has a fastening strip of which a bottom edge protrudes downward to form two elastic arms spaced from each other, and a soldering portion between the two elastic arms. The elastic arms are apart from two opposite side edges of the soldering portion to define two receiving intervals between the soldering portion and the elastic arms. Distal ends of the elastic arms oppositely protrude to form two fastening barbs. The soldering portion and the elastic arms are inserted in the receiving cavity. The fastening barbs slide through the blocking eaves to be hooked under the blocking eaves respectively and the fastening barbs can be avoided scraping the connector by means of cushion effects of the receiving intervals.

3 Claims, 3 Drawing Sheets

CONNECTOR TERMINAL

BACKGROUND OF THE INVENTION

1. Field of the Invention

The present invention generally relates to a terminal, and more particularly to a terminal used in a connector.

2. The Related Art

Referring to FIG. 1, a conventional connector terminal 20' disposed in a connector 10' is shown. The connector terminal 20' has a fastening strip 21' and an inserting plate 22' protruded downward from a portion of a bottom edge of the fastening strip 21'. Two opposite side edges of a lower portion of the inserting plate 22' oppositely protrude outward to form a pair of fastening barbs 23'. The connector 10' defines an inserting cavity 11' vertically extending. The connector terminal 20' is assembled in the connector 10' with the inserting plate 22' being inserted downward in the inserting cavity 11'. The fastening barbs 23' abut against two opposite insides of the inserting cavity 11' to secure the connector terminal 20' in the connector 10'. However, the fastening barbs 23' are apt to scrape the connector 10' in the process of the inserting plate 22' being inserted into the inserting cavity 11', and furthermore, when the connector terminal 20' is pressed forward or rearward by external force.

SUMMARY OF THE INVENTION

An object of the present invention is to provide a connector terminal assembled in an insulating housing of a connector. The insulating housing defines a receiving cavity penetrating vertically through the insulating housing. Two upper portions of front and rear sides of the receiving cavity protrude face-to-face to form a pair of blocking eaves apart from each other. The connector terminal includes a base strip, a fastening strip extending forward from a front end of the base strip, and a contact tail connected with a rear end of the base strip. The bottom edge of the fastening strip has two portions protruded downward to form a pair of elastic arms spaced from each other, and a substantial middle protruded downward to form a soldering portion between the pair of elastic arms. The elastic arms are apart from two opposite side edges of the soldering portion to define two receiving intervals between the soldering portion and the elastic arms respectively. Distal ends of the pair of elastic arms protrude oppositely to the receiving intervals to form two fastening barbs. The soldering portion and the elastic arms of the connector terminal are inserted downward in the receiving cavity. The fastening barbs slide through the blocking eaves to be hooked under the blocking eaves respectively and the fastening barbs can be avoided scraping the connector by means of cushion effects of the receiving intervals, whether in the process of assembling the connector terminal into the insulating housing or under the condition of the connector terminal being pressed forward or rearward by external force.

As described above, the connector terminal of the present invention utilizes the cushioning effects of the receiving intervals which are formed between the elastic arms and the soldering portion to facilitate the fastening barbs to slide through the corresponding blocking eaves so as to be hooked under the corresponding blocking eaves, and furthermore, to avoid the fastening barbs scraping the connector whether in the process of assembling the connector terminal into the insulating housing or under the condition of the connector terminal being pressed forward or rearward by the external force.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
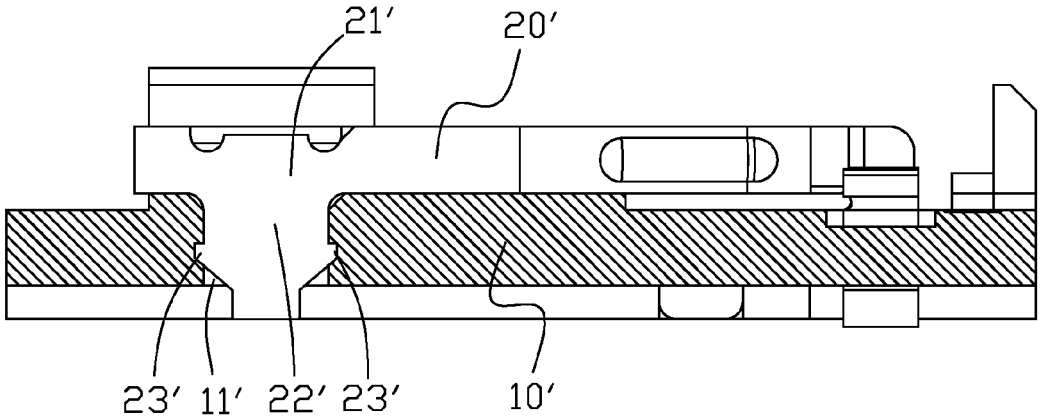
FIG. 1 (Prior Art)
FIG. 1 is a cross-sectional view showing that a connector terminal is assembled in a connector according to a prior art.
Figure 2:
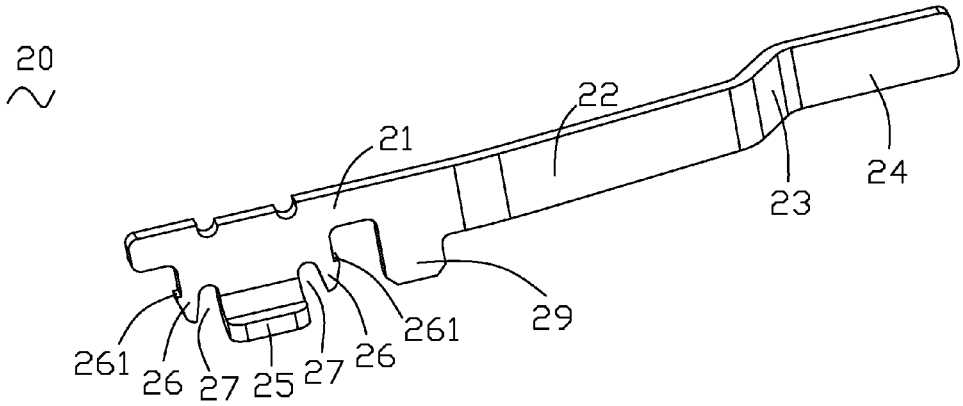
FIG. 2 is a perspective view of a connector terminal according to an embodiment of the prevent invention.
Figure 3:
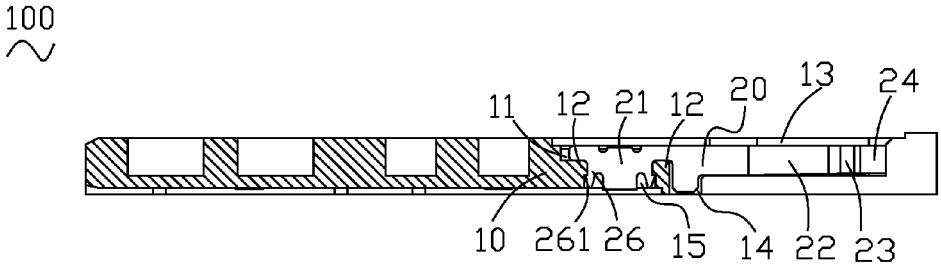
FIG. 3 is a cross-sectional view showing that the connector terminal of FIG. 2 is assembled in a connector according to the prevent invention.

Referring to FIG. 2 and FIG. 3, a connector terminal 20 in accordance with an embodiment of the present invention is shown. The connector terminal 20 is used in a connector 100 and assembled in an insulating housing 10 of the connector 100. In this embodiment, the connector terminal 20 is a switch terminal.

Referring to FIG. 2 again, the connector terminal 20 has a long and narrow base strip 22, and a fastening strip 21 extending forward from a top of a front end of the base strip 22. A rear end of the base strip 22 is bent sideward to form a connecting portion 23. A free end of the connecting portion 23 extends rearward and oppositely to the base strip 22 to form a contact tail 24. A rear of a bottom edge of the fastening strip 21 protrudes downward to form a blocking portion 29 adjacent to the base strip 22 and further protruded beyond a bottom of the base strip 22. Two portions of the bottom edge of the fastening strip 21 protrude downward to form a pair of elastic arms 26 spaced from each other and apart from the blocking portion 29. A substantial middle of the bottom edge of the fastening strip 21 further protrudes downward and then is bent towards a direction opposite to the bent direction of the connecting portion 23 to form a soldering portion 25 located between the pair of elastic arms 26. The pair of elastic arms 26 is apart from two opposite side edges of the soldering portion 25 to define two receiving intervals 27 between the side edges of the soldering portion 25 and the elastic arms 26 respectively. Distal ends of the pair of elastic arms 26 protrude oppositely to the receiving intervals 27 to form a pair of fastening barbs 261.

Referring to FIG. 3 again, a top of the insulating housing 10 defines a receiving fillister 13 substantially extending along a front-to-rear direction thereof. A top of a front end of the receiving fillister 13 further extends forward to form a fastening fillister 11. A rear of a bottom side of the fastening fillister 11 is concaved downward to form an inserting cavity 14 adjacent to the receiving fillister 13 and having a deeper depth than that of the receiving fillister 13. A substantial middle of the bottom side of the fastening fillister 11 is further concaved downward to form a receiving cavity 15 penetrating through a bottom of the insulating housing 10. Two upper portions of a front side and a rear side of the receiving cavity 15 protrude face-to-face to form a pair of blocking eaves 12 apart from each other.

Figure 4:
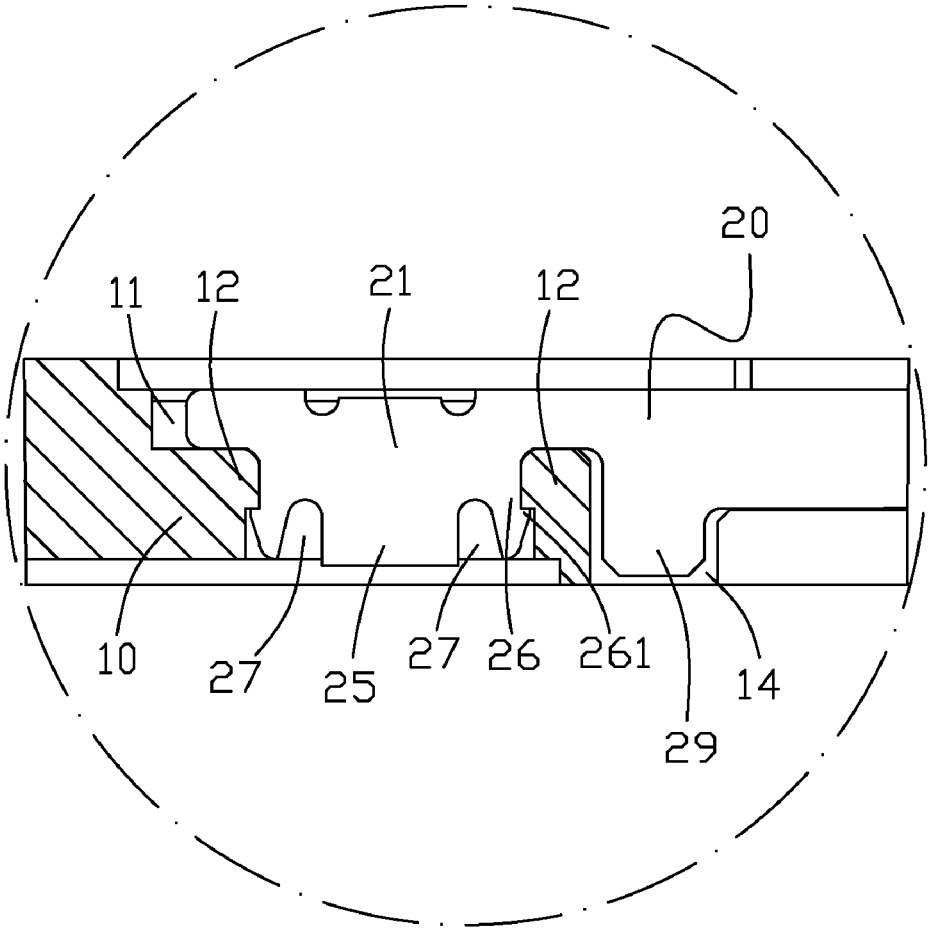
FIG. 4 is an enlarged view of a part in FIG. 3, showing an engagement between the connector terminal and the connector.

Referring to FIGS. 2-4, in assembly, the base strip 22, the connecting portion 23 and the contact tail 24 of the connector terminal 20 are disposed in the receiving fillister 13 of the insulating housing 10. The fastening strip 21 is fastened in the fastening fillister 11 by means of the blocking portion 29 inserted downward in the inserting cavity 14, the soldering portion 25 and the elastic arms 26 inserted downward in the receiving cavity 15, and the fastening barbs 261 hooked under the blocking eaves 12 respectively. In the process of the elastic arms 26 and the soldering portion 25 being inserted into the receiving cavity 15, the fastening barbs 261 can conveniently slide through the corresponding blocking eaves 12 under cushion effects of the receiving intervals 27 to be hooked under the blocking eaves 12 respectively so that avoids the fastening barbs 261 scraping the connector 100. Furthermore, when the connector terminal 20 is pressed forward or rearward by external force, the receiving intervals 27 further utilize the cushioning effects thereof to avoid the fastening barbs 261 scraping the connector 100.

As describe above, the connector terminal 20 of the present invention utilizes the cushioning effects of the receiving intervals 27 which are formed between the elastic arms 26 and the soldering portion 25 to facilitate the fastening barbs 261 to slide through the corresponding blocking eaves 12 so as to be hooked under the corresponding blocking eaves 12, and furthermore, to avoid the fastening barbs 261 scraping the connector 100 whether in the process of assembling the connector terminal 20 into the insulating housing 10 or under the condition of the connector terminal 20 being pressed forward or rearward by the external force.

What is claimed is:

1. A connector terminal assembled in an insulating housing of a connector, the insulating housing defining a receiving cavity penetrating vertically through the insulating housing, two upper portions of front and rear sides of the receiving cavity protruding face-to-face to form a pair of blocking eaves apart from each other, the connector terminal comprising:

a base strip;

a fastening strip extending forward from a front end of the base strip, a bottom edge of the fastening strip having two portions protruded downward to form a pair of elastic arms spaced from each other, and a substantial middle protruded downward to form a soldering portion between the pair of elastic arms, the elastic arms being apart from two opposite side edges of the soldering portion to define two receiving intervals between the soldering portion and the elastic arms respectively, distal ends of the pair of elastic arms protruding oppositely to the receiving intervals to form two fastening barbs; and a contact tail connected with a rear end of the base strip;

wherein the soldering portion and the elastic arms of the connector terminal are inserted downward in the receiving cavity, the fastening barbs slide through the blocking eaves to be hooked under the blocking eaves respectively and the fastening barbs can be avoided scraping the connector by means of cushion effects of the receiving intervals, whether in the process of assembling the connector terminal into the insulating housing or under the condition of the connector terminal being pressed forward or rearward by external force.

2. The connector terminal as claimed in claim 1, wherein a rear of the bottom edge of the fastening strip protrudes downward to form a blocking portion adjacent to the base strip and apart from the elastic arms, the blocking portion is inserted downward in the insulating housing to further secure the connector terminal in the connector.

3. The connector terminal as claimed in claim 1, wherein the rear end of the base strip is bent sideward to form a connecting portion, the contact tail is formed by extending rearward and oppositely to the base strip from a free end of the connecting portion.

* * * * *